US007090397B2

(12) United States Patent
Stolmeier

(10) Patent No.: US 7,090,397 B2
(45) Date of Patent: Aug. 15, 2006

(54) SINGLE USE CONTAINER

(76) Inventor: Robert C. Stolmeier, 701 Hodell St., Shelbyville, IN (US) 46176

( * ) Notice: Subject to any disclaimer, the term of this patent is extended or adjusted under 35 U.S.C. 154(b) by 0 days.

(21) Appl. No.: 10/859,657

(22) Filed: Jun. 3, 2004

(65) Prior Publication Data

US 2005/0025392 A1 Feb. 3, 2005

Related U.S. Application Data

(60) Provisional application No. 60/475,431, filed on Jun. 3, 2003.

(51) Int. Cl.
*B65D 33/16* (2006.01)

(52) U.S. Cl. ..... 383/64; 383/5; 383/61.2; 383/204

(58) Field of Classification Search ..... 383/5, 383/64, 61.2, 59, 210–211, 203–204
See application file for complete search history.

(56) References Cited

U.S. PATENT DOCUMENTS 1,201,519 A 10/1916 Sorensen
1,959,318 A 5/1934 Sundback
2,181,252 A 11/1939 Vogel
2,358,653 A 9/1944 Mock
3,346,883 A 10/1967 Ersek
3,440,696 A * 4/1969 Staller ..... 24/586.1
3,808,649 A 5/1974 Ausnit
3,933,304 A 1/1976 Judd
4,180,929 A 1/1980 Schultz, Jr.
4,348,440 A 9/1982 Kriozere
4,468,811 A 8/1984 Shaw et al.
4,483,018 A 11/1984 Whelan
4,541,117 A 9/1985 Ashbeck
4,566,627 A 1/1986 Gendron
4,637,060 A 1/1987 Ausnit
4,653,113 A 3/1987 Taylor
4,709,396 A 11/1987 Voshall et al.
4,709,397 A 11/1987 Voshall et al.
4,712,729 A 12/1987 Craig
4,713,839 A 12/1987 Peppiatt
4,718,553 A 1/1988 Adamoli et al.
4,736,450 A 4/1988 Van Erden et al.
4,744,674 A 5/1988 Nocek
4,759,643 A 7/1988 Canno
4,785,940 A 11/1988 Wilson
4,791,710 A * 12/1988 Nocek et al. ..... 24/585.12
4,927,271 A 5/1990 Branson
4,941,196 A 7/1990 Edelman et al.
4,947,525 A 8/1990 Van Erden
4,964,739 A * 10/1990 Branson et al. ..... 383/5
5,007,146 A 4/1991 Meidan
5,017,021 A 5/1991 Simonsen et al.
5,108,194 A 4/1992 Raden
5,113,555 A 5/1992 Wilson et al.
5,140,796 A * 8/1992 Pope ..... 53/390
5,174,658 A 12/1992 Cook et al.

(Continued)

FOREIGN PATENT DOCUMENTS

DE 3342256 6/1983

(Continued)

*Primary Examiner*—Jes F. Pascua
(74) *Attorney, Agent, or Firm*—John V. Daniluck; Bingham McHale LLP

(57) ABSTRACT

A single use container comprises a slider having first and second closable profiles having an adhesive or epoxy disposed thereon. The profiles are configured, for example, to prevent premature closing and bonding.

14 Claims, 7 Drawing Sheets

U.S. PATENT DOCUMENTS 5,205,649 A 4/1993 Fullerton
5,211,482 A 5/1993 Tilman
5,318,364 A 6/1994 Raden
5,346,739 A 9/1994 Nassoiy
5,350,238 A 9/1994 Bolton
5,352,041 A 10/1994 Fullerton et al.
5,360,270 A 11/1994 Appeldorn et al.
5,391,136 A 2/1995 Makowka
5,399,405 A 3/1995 Rennels, Jr. et al.
5,405,197 A 4/1995 Makowka
5,407,277 A 4/1995 Burke et al.
5,474,382 A * 12/1995 May ..... 383/211
5,510,171 A 4/1996 Faykish
5,527,112 A 6/1996 Dais et al.
5,564,834 A 10/1996 Porchia et al.
5,573,614 A 11/1996 Tilman et al.
5,575,747 A 11/1996 Dais et al.
5,605,594 A 2/1997 May
5,620,256 A 4/1997 Makrauer
5,631,068 A 5/1997 Smith
5,658,411 A 8/1997 Faykish
5,683,774 A 11/1997 Faykish et al.
5,711,609 A 1/1998 Simonsen
5,770,283 A 6/1998 Gosselin et al.
5,783,012 A 7/1998 Porchia et al.
5,788,378 A 8/1998 Thomas
5,791,783 A 8/1998 Porchia et al.
5,798,169 A 8/1998 Smith
5,809,621 A 9/1998 McCree et al.
5,832,145 A 11/1998 Dais et al.
5,851,071 A 12/1998 Arnell
5,908,243 A 6/1999 Hanning
5,918,983 A 7/1999 Palazzolo
5,927,855 A 7/1999 Tomic et al.
5,931,581 A 8/1999 Garberg et al.
5,947,604 A 9/1999 Bang et al.
5,964,532 A 10/1999 St. Phillips et al.
6,004,032 A 12/1999 Kapperman et al.
6,012,844 A 1/2000 Huseman et al.
6,048,098 A 4/2000 Vetter
6,053,535 A 4/2000 Washburn et al.
6,071,011 A 6/2000 Thomas et al.
6,112,374 A 9/2000 Van Erden
6,148,588 A 11/2000 Thomas et al.
6,152,600 A 11/2000 Tomic
6,167,679 B1 1/2001 Horton-Steidle et al.
6,185,796 B1 2/2001 Ausnit
6,196,716 B1 3/2001 Geyer
6,217,215 B1 4/2001 Tomic
6,267,505 B1 7/2001 Henson
6,279,298 B1 8/2001 Thomas et al.
6,284,337 B1 9/2001 Lorimor et al.
6,286,999 B1 9/2001 Cappel et al.
6,290,393 B1 * 9/2001 Tomic ..... 383/210.1
6,409,871 B1 6/2002 Washburn et al.
6,419,391 B1 7/2002 Thomas
6,439,770 B1 8/2002 Catchman
6,447,015 B1 9/2002 Linnewiel
6,461,042 B1 10/2002 Tomic et al.
6,461,043 B1 10/2002 Healy et al.
6,481,890 B1 * 11/2002 VandenHeuvel ..... 383/64
6,539,594 B1 4/2003 Kasai et al.
6,575,625 B1 6/2003 Cappel
6,578,731 B1 6/2003 Lewis et al.
6,581,253 B1 6/2003 ErkenBrack
6,581,358 B1 6/2003 Buchman
6,609,827 B1 8/2003 Bois et al.
6,611,996 B1 9/2003 Blythe et al.
6,616,333 B1 9/2003 Kinigakis et al.
6,622,353 B1 9/2003 Provan et al.
6,632,021 B1 10/2003 Bois et al.
6,662,410 B1 12/2003 Kolovich et al.
6,663,283 B1 12/2003 Cappel
6,686,005 B1 2/2004 White et al.
6,712,509 B1 3/2004 Cappel
6,713,152 B1 3/2004 Chen et al.
6,732,491 B1 5/2004 Buchman
6,733,178 B1 5/2004 Bois
6,755,569 B1 6/2004 Bois
6,761,481 B1 7/2004 Bois
6,780,146 B1 8/2004 Thomas et al.
6,805,485 B1 10/2004 Hogan et al.
6,834,474 B1 12/2004 Dutra et al.
6,871,473 B1 3/2005 Dutt et al.
6,874,935 B1 4/2005 Edelman et al.
6,902,321 B1 6/2005 Bois
6,918,234 B1 7/2005 Thomas et al.
6,939,041 B1 9/2005 Kinigakis et al.
2004/0064923 A1 4/2004 Gzybowski
2004/0184681 A1 * 9/2004 Arnell ..... 383/64

FOREIGN PATENT DOCUMENTS

GB 1536784 A 12/1978
GB 2051003 A 1/1981
GB 2149381 A 6/1985
GB 2167381 A 5/1986
WO WO 2004/083064 A1 9/2004

* cited by examiner

SINGLE USE CONTAINER

RELATED APPLICATION

Pursuant to 37 C.F.R. § 1.78(a)(4) and 35 U.S.C. § 119(e), this application claims the benefit of U.S. Provisional Application Ser. No. 60/475,431, filed Jun. 3, 2003.

FIELD OF THE INVENTION

This invention generally relates to security bags or containers, and in particular to single use or tamper evident containers.

DESCRIPTION OF THE RELATED ART

Many industries, such as the financial services, armored car and retail and grocery store industries purchase security bags to move money and other important documents from one location to another. It is desirable that a security bag be capable of evidencing tampering that may have occurred as the bag is moved from a first location where it is filled to a second location where it is desired that the contents be delivered with confirmation that no tampering of the bag's contents has occurred. A security bag protects the contents of the bag from unauthorized tampering. This object has been accomplished by incorporating various security features such as, for example, tamper evident "void tape" or sequential numbering on both the bag and tear off receipts. However, such products have not proven to be completely satisfactory and improved security bags and/or containers are needed.

Prior art devices have also utilized an adhesive disposed on one or both of the closing strips such that the strips are pressed securely together to close the bag. To open the bag after closing it becomes necessary to tear the bag, which, of course destroys the bag and provides evidence of tampering. Such bags are prone to premature closing, for example, when the strips come into contact with one another during manufacturing or shipping, or if they inadvertently come into contact at any time. Bags that close prematurely cannot thereafter be used.

SUMMARY OF THE INVENTION

Accordingly, the present invention comprises a tamper resistant or single use container. One embodiment of the invention includes a bag or flexible container having an opening with a pair of interlocking fastener strips and a slider for closing the strips. A bonding agent such as an adhesive or epoxy is disposed on at least one of the fasteners strips. The slider is movable along the strips to fuse them together so that the bag must be torn apart to gain entry.

In another embodiment of the invention, there may be no end stops on one or both ends of the profiles so that the slider may be moved off of the fasteners strips and thrown away. Still another embodiment of the invention may include the feature of microencapsulated bonding agents such that movement of the slider crushes the capsules resulting in the combining of a two-part epoxy compound. A further embodiment of the invention involves two pair of profiles, one being a single use profile and the other being a reclosable closure. Either one of the two pair could be the external pair of profiles.

These and other objects of the present invention will be classified in the following description of the preferred embodiments in connection with the drawings, the disclosure and the appended claims, wherein like reference numerals represent like elements throughout. The drawings constitute a part of this application and include exemplary embodiments of the present invention and illustrate various features thereof.

Figure 1:
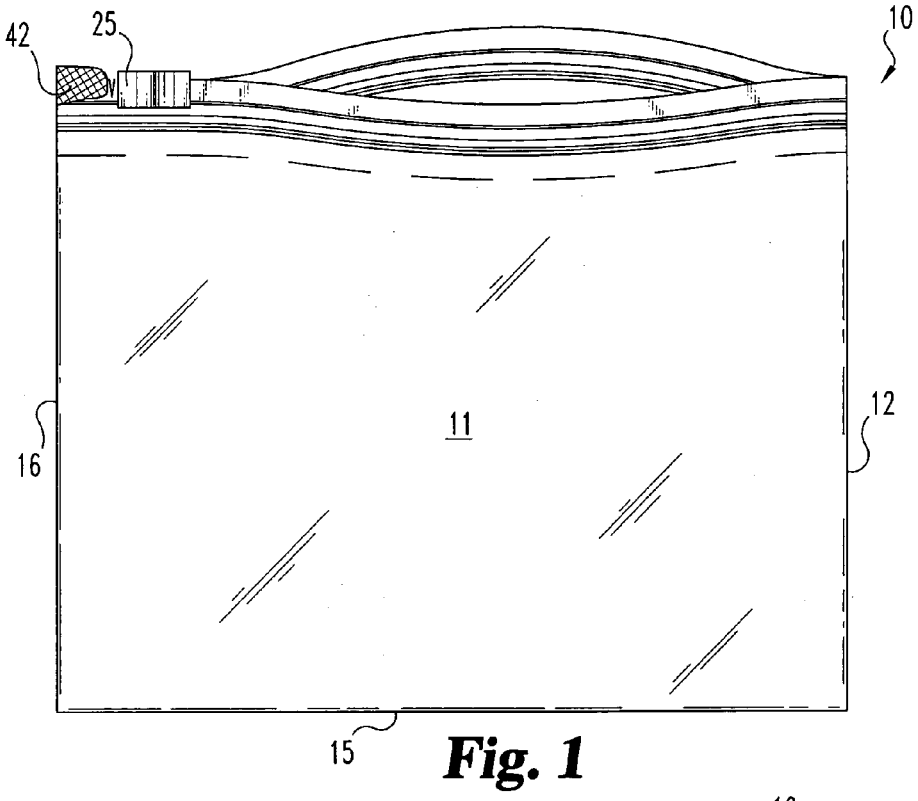
FIG. 1 is a front elevational view of a flexible container embodying the present invention.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a flexible container or bag 10 comprising two sheets 11 of plastic film which are joined or sealed together at edges 12, 15 and 16. The bag 10 may be made from any suitable thermoplastic film such as, for example, low density polyethylene, linear low density polyethylene, substantially linear copolymers of ethylene and a C3–C8 $\propto$-olefin, polypropylene, polyvinylidene chloride, or mixtures of two or more of these polymers or mixtures of one of these polymers with another thermoplastic polymer. The sheets 11 of film should, however, be capable of showing any perforation or tear that is present in or performed upon the sheets 11.

Figure 3:
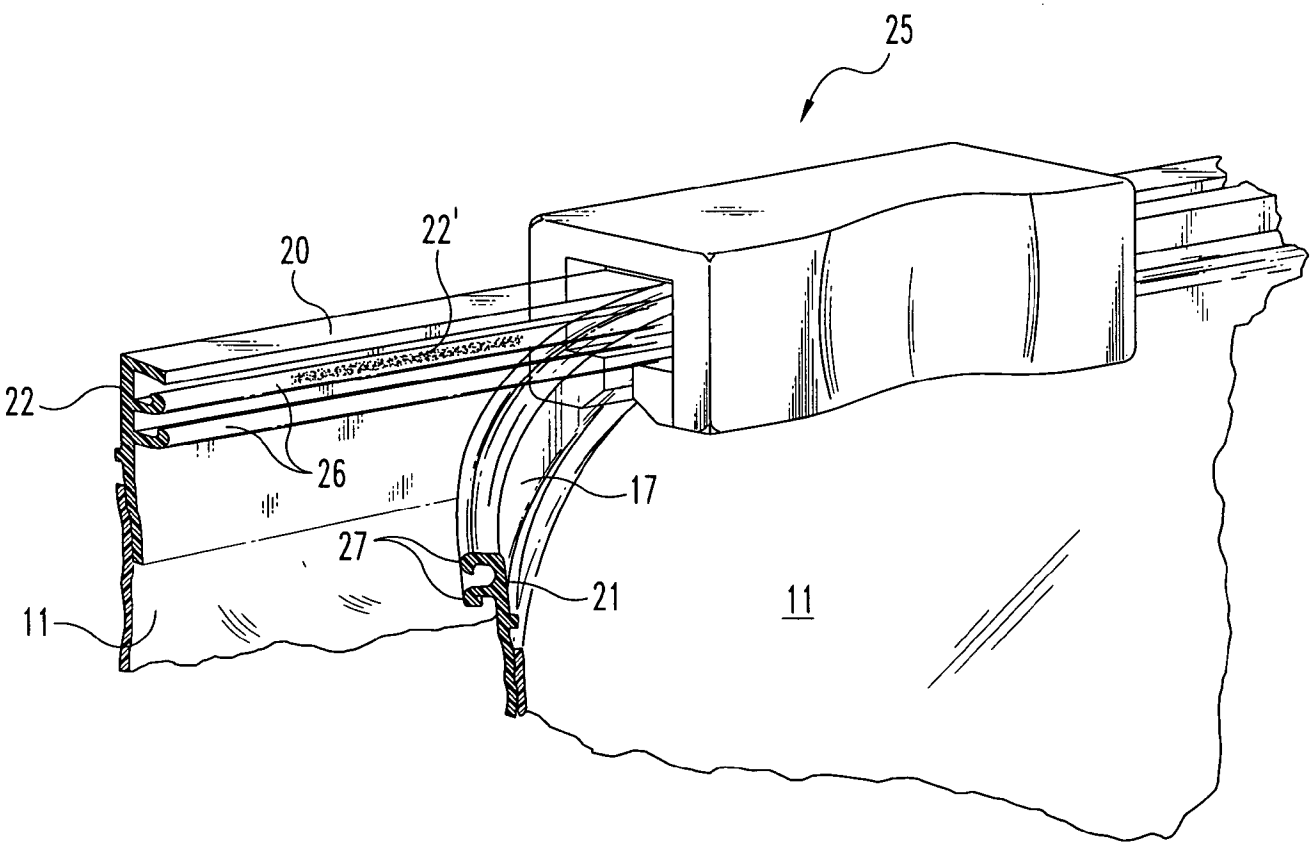
FIG. 3 is a fragmentary perspective view of the container and slider of the invention but looking at the container in the opposite direction from FIGS. 1 and 2.

Referring to FIG. 3, mounted on the upper edges of the sheets 11 is a pair of interlocking fastener strips 17 and 20 which include, respectively, first and second interlocking profiles 21 and 22 (e.g., hook-like interlocking) and respectively first and second flanges 23, 24. When the bag is open, i.e., before the closure assembly or slider 25 is moved, the profiles are misaligned, i.e., not engaged. When the bag is closed, the first profile 21 interlocks with the second profile 22 so that the profiles are interlocked throughout their entire length thereby forming a seal by virtue of the two part epoxy.

Figure 2:
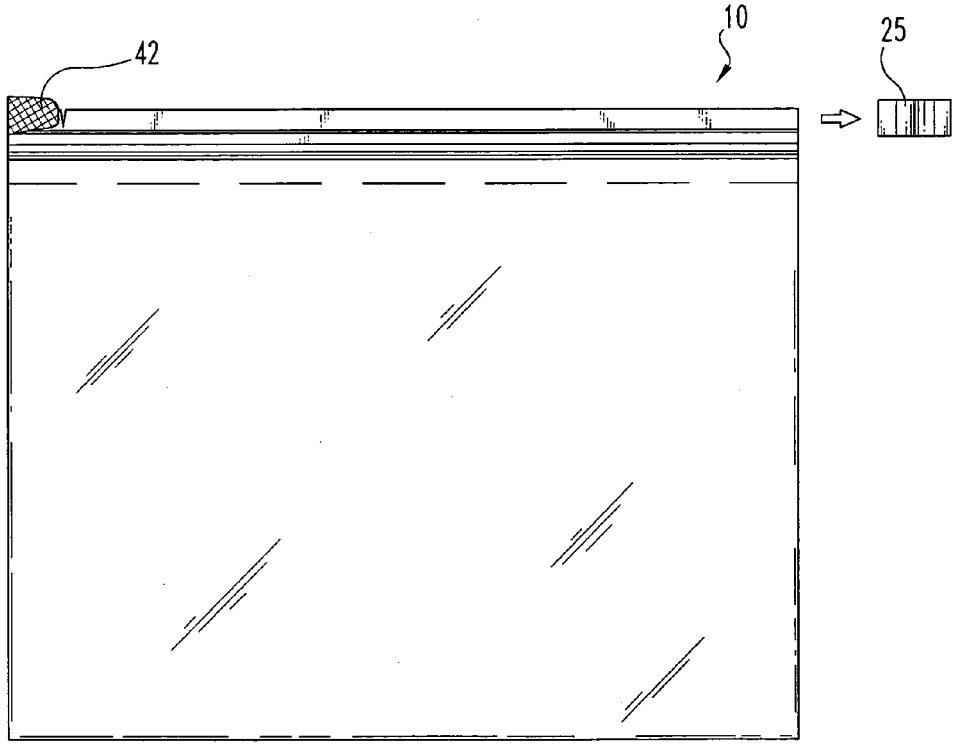
FIG. 2 is a view similar to FIG. 1 showing the container in a different operating position.

The closure or interlocking of the profiles is achieved by moving the slider 25 from the position of FIG. 1 to the position of FIG. 2, that is, by moving the slider completely off of the bag 10 (FIG. 3 illustrates the position of the slider 25 with a portion of the bag open and a portion of the bag closed). The slider 25 comprises suitable means, such as closing bars 37 (see FIG. 4) or 57 (see FIG. 8), for forcing the profiles 21 and 22 together so that they become interlocked when the slider 25 is moved to the position illustrated in FIG. 2. As illustrated in FIG. 1 and FIG. 2, an end stop 42 is provided which prevents the slider 25 from sliding off of the leftward end of the container 10.

Referring to FIG. 3, at or adjacent the contacting surfaces 26 and 27 of the profiles 21 and 22 there is provided a bonding agent such as a two-part epoxy compound. One part of the epoxy may be provided on or in the profile 21 and the other part on or in the profile 22. Alternatively, any other type of permanently adhering adhesive 22' may be provided on or adjacent the contacting surfaces of at least one of the profiles 21 and 22. The epoxy compound and/or the adhesive 22' is chosen such that the effect of the coming together of the profiles 21 and 22 causes them to be connected with a strength greater than the strength of the materials of the profiles 21.

Thus, in the event that an effort is made to separate the profiles 21 and 22 after they have been closed by the slider, they cannot be separated without tearing one or the other of the profiles, thereby providing tamper evidence.

Figure 4:
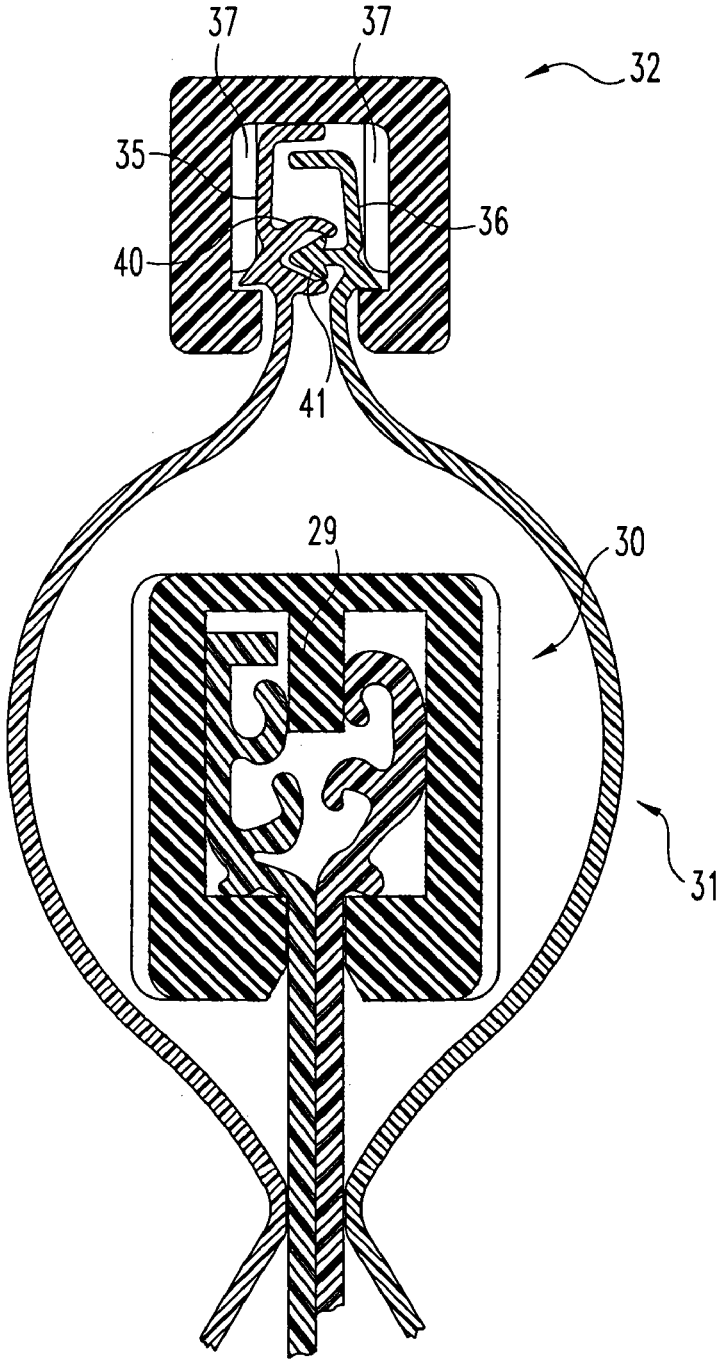
FIG. 4 is a fragmentary section of an alternative embodiment of the invention having two pairs profiles, one of which may be a single use profile and the other of which may be a reusable profile.

FIG. 4 illustrates a further embodiment of the invention comprising a reclosable closure 30 located internally of a container 31 (shown only fragmentarily). The reclosable closure 30 does not include any epoxy or adhesive material but includes a separator 29 which operates to separate the profiles and open the bag when the slider is moved in one direction. When the slider is moved in the opposite direction closing bars (not shown) force the profiles together. The container 31 also includes a single use slider 32 which is mounted on fastener strips 35 and 36 and includes adhesive or epoxy materials as discussed above. The slider 32 has opposing closing bars 37 which force the profiles 40 and 41 of the fastener strips together to securely close the profiles.

Figure 5:
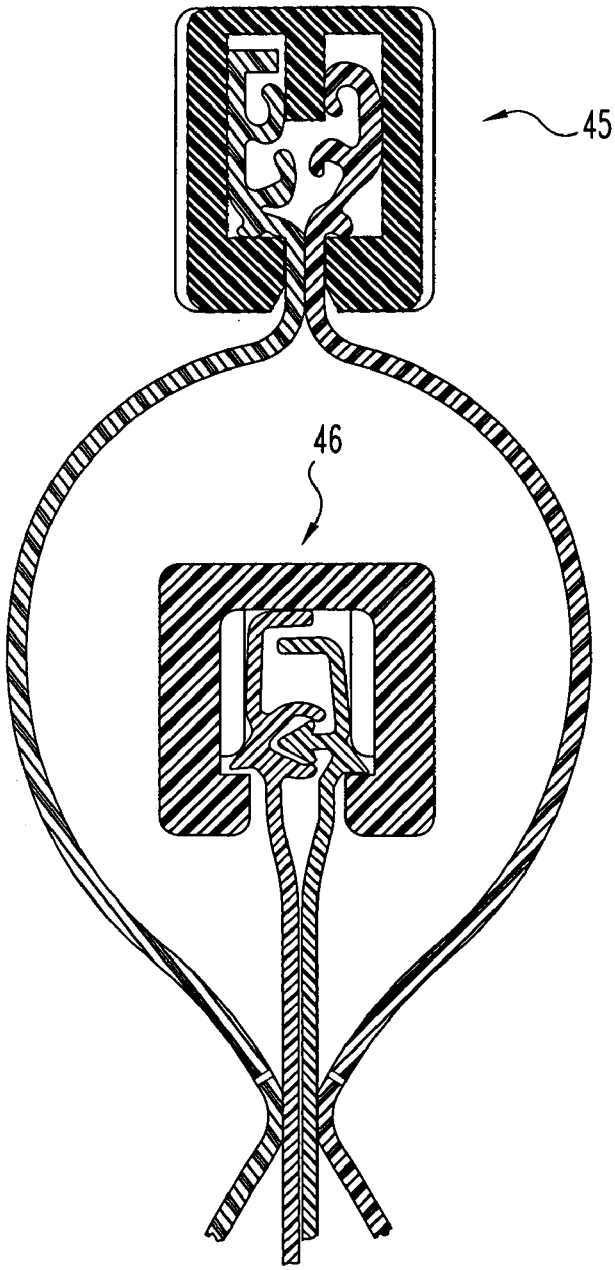
FIG. 5 is a fragmentary view similar to FIG. 4 of another alternative embodiment of the invention.

FIG. 5 illustrates a further embodiment of the invention that is identical to the embodiment of FIG. 4, except that the configuration of the reclosable closure and the single use closure is reversed, that is, the reclosable closure 45 is located externally from the single use closure 46.

Figure 6:
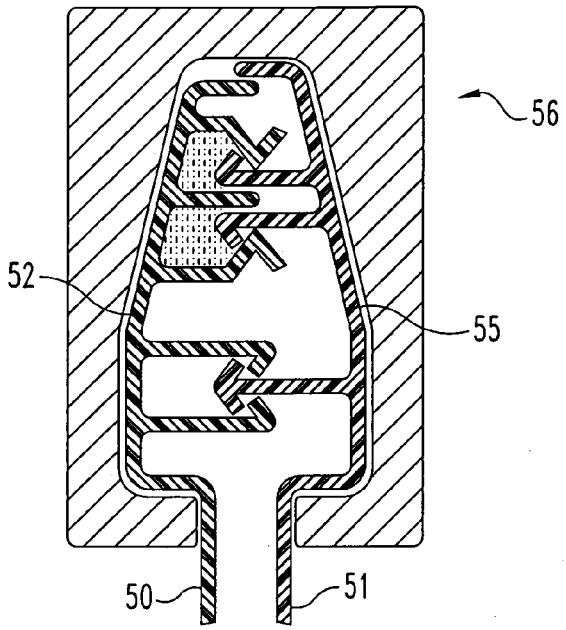
FIG. 6 is a fragmentary sectional view of a further alternative embodiment of the invention comprising a film covering an adhesive.
Figure 7:
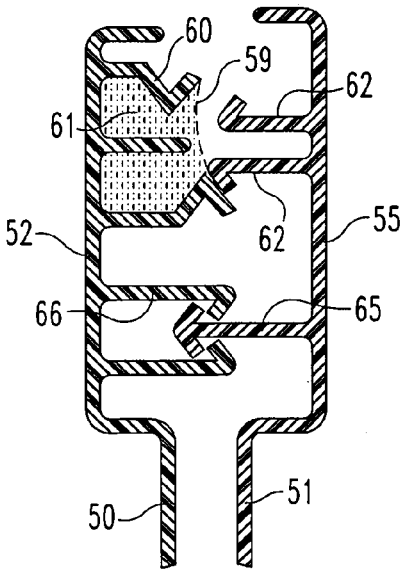
FIG. 7 is a view similar to FIG. 6 of the embodiment of FIG. 6 but showing the profiles prior to closure.
Figure 8:
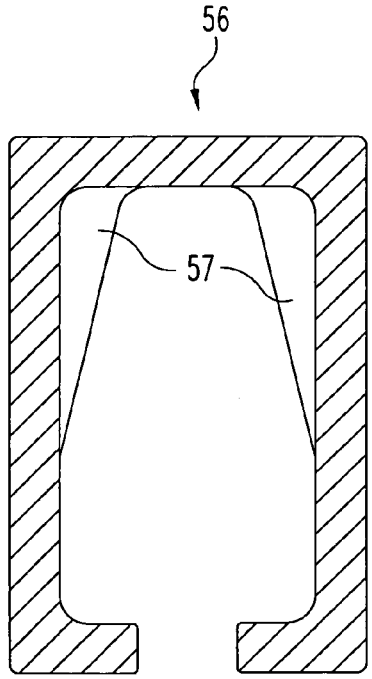
FIG. 8 is a sectional view of a slider forming a part of the embodiment of FIGS. 6 and 7.

FIGS. 6–8 illustrate an additional embodiment of the invention comprising fastener strips 50 and 51 which include, respectively, first and second profiles 52 and 55. FIG. 7 illustrates the profiles prior to being closed by the slider 56. FIG. 6 illustrates the profiles after they have been closed by the slider 56, which has inwardly extending closing bars 57.

Referring in detail to FIG. 7, the first profile 52 includes a female portion 60 that is filled with adhesive 61 and is closed off during manufacture by a film 59 which prevents the epoxy or adhesive material from bonding with the second profile 55. The film 59 may, for example, be extruded over the adhesive 61 during manufacturing. The film 59 should be made from a material suitable to resist surface contact incidental to the manufacturing, shipping and the like and to withstand variations in temperature, humidity and the like.

In operation, moving the slider 56 along the fastener strips to the position illustrated in FIG. 6 causes the dual male portion 62 to puncture the film 59 and to couple with the female portion 60 as shown in FIG. 6. The profiles 52 and 55 may also include secondary male portion 65 and female portion 66 which function to keep the profiles together, for example during manufacturing, extrusion, shipping, bag making, etc.

Figure 9:
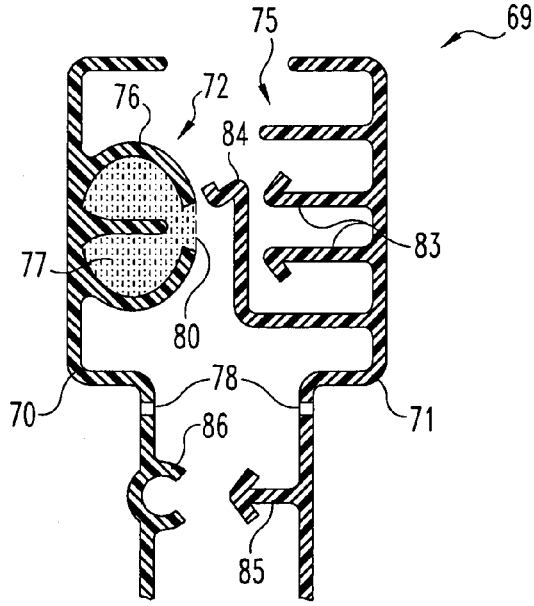
FIG. 9 is a view similar to FIG. 7 of a further embodiment of the invention comprising a guard formed along an interior portion of a slider.

FIG. 9 illustrates another embodiment of the present invention comprising closure assembly 69 having fastener strips 70 and 71. The fastener strips include respective first and second profiles 72 and 75. The closure assembly 69 is similar to the embodiments of FIGS. 6–8 in that it includes a female portion 76 which is filled with adhesive 77 and is closed off during manufacture by a film 80. As illustrated in FIG. 9, a guard 84 extends inwardly from fastener strip 71 and is generally positioned between male portions 83 and female portions 76. The guard 84 prevents premature closing of the fastener strips 70 and 71. The guard 84 functions to protect the film 80 and the adhesive 77 so that the dual male portion 83 does not puncture the film 80. The fastener strips 70 and 71 include secondary male portion 85 and female portion 86, respectively, which have the same function and purpose as the portions 65 and 66 described above. Fastener strips 70 and 71 have scored portions 78 to permit easy separation of first profile 72 and second profile 75 from the respective fastener flange so as to provide evidence of tampering.

Figure 11:
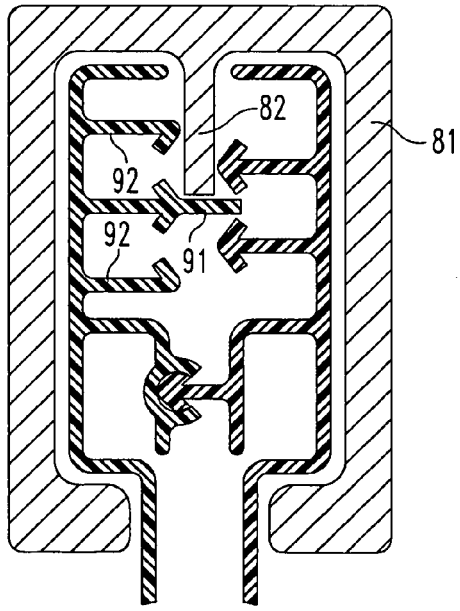
FIG. 11 is a sectional view of the embodiment of FIG. 10 but also showing a slider on the profiles.

Closure assembly 69 also comprises a slider such as the slider 81 shown in FIG. 11 which has a separator 82. During operation, as the slider 81 is moved to close the bag, the separator 82 functions to depress the guard 84 and allows the male portions 83 to puncture the film 80 to allow the profiles to securely bond. That is, when it is desired to close and seal the bag, the separator 82 pushes the protector 84 downwardly out of the way so that the dual male portion 83 can puncture the film 80 and mate with the female portion 76.

Figure 10:
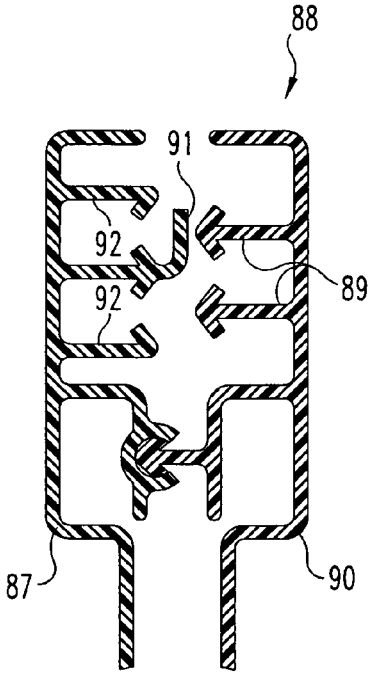
FIG. 10 is a view similar to FIG. 9 of still another embodiment of the invention.

FIGS. 10 and 11 illustrate a further embodiment 88 of the present invention comprising fastener strips 87 and 90. This embodiment includes a shield or protector 91 that has the same purpose and function as the guard 84 discussed above. As illustrated in FIG. 10, the protector extends generally inwardly from the fastener strip 87 and is located between the male and female portions 89 and 92, respectively. An epoxy or adhesive is provided in or on the walls of the male and/or female portions 89 and 92.

The protector 91 is shown in FIG. 10 in its initial position wherein it protects the inside of the female portion 92 and prevents premature closure of the fastener strips. FIG. 11 shows the action of the slider 81 as it is moved from the position of FIG. 1 to the position of FIG. 2. As shown in FIG. 11 the separator 82 engages the shield 91 and moves it to a position wherein it does not block the dual male portion 89 and allows it to close with the female portion 92 to seal the bag. Such sealing does not occur, however, until after the separator 82 passes between the male and female portions and closing bars (not shown) such that the closing bars force the male and female portions 89 and 92 together.

Figure 12:
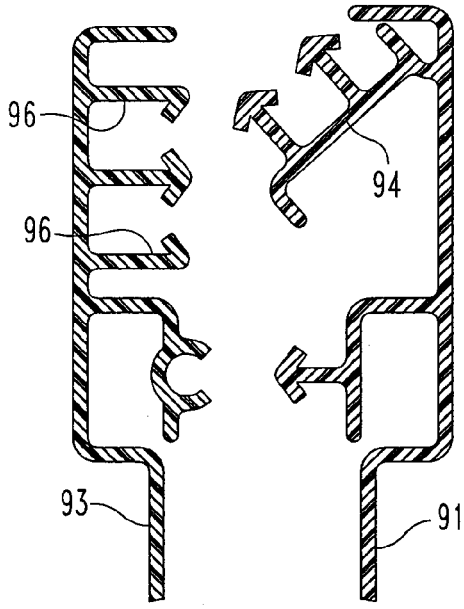
FIGS. 12 and 13 are sectional views of still another embodiment of the invention comprising an offset or misaligned slider assembly.
Figure 13:
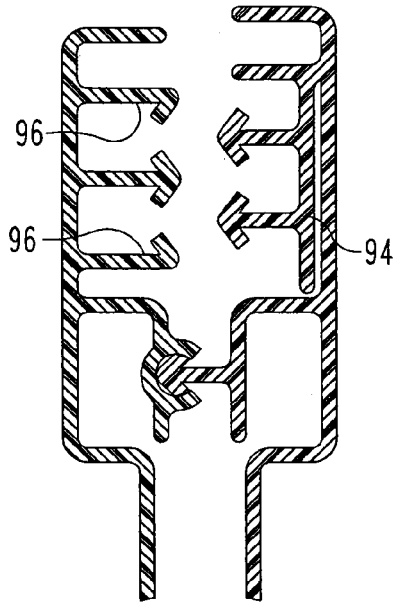

FIGS. 12 and 13 illustrate a further embodiment of the invention comprising a closure assembly 89 which includes fastener strips 91 and 93. As illustrated in FIG. 12, male profile portion 94 is extruded generally at an angle wither respect to the side wall of the fastener strip 91 such that if the fastener strips 91 and 93 are pressed together (e.g., during manufacture, shipping, etc.) the male profile portion 94 is out of alignment with the female profile portion 96 so that it cannot close to seal the profile portions together. Referring to FIG. 13, when the separator 99 passes between the fastener strips 91 and 93 the male profile portion is forced downward such that the fastener strips be sealed to one another by the closing bars of the slider. Similarly to one or more of the other disclosed embodiments adhesive may be used with this embodiment by filling the female profile portion 96 with adhesive and providing a film such as the film 80. Alternatively epoxy may be used on the surface or near the surface of the male and female portions 94 and 96 for securing the fastener strips together.

Any and all of the aforementioned embodiments can be modified to include one or more mechanically scored or laser scored portions (e.g., near the center of the length of the profiles, or at various places along the length thereof, or along the entire length thereof). Such scored portions may be provided to weaken the attachment of either the male or the female profile to the flange of the fastener strips. For example, if there is a single, short line of weakening between a profile and the fastener flange, then during an attempt to open the bag the profiles would easily separate only at this weakened area. This weakened area can be sized to be small enough to not permit access to the interior of the bag yet big enough to allow a finger or two into the interior of the bag, such that the person would be able to tear it apart to provide evidence of tampering.

In another embodiment, there could be a score line between a fastener profile and the flange of the fastener strips as described above, leading to a second score line. The second destruction could be along a second score line (such as one that extends at an angle from the first score line).

Although the foregoing detailed description of the present invention has been described by reference to two exemplary embodiments, and the best mode contemplated for carrying out the present invention has been shown and described, it will be understood that modification or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations, equivalents that fall with in the true spirit and scope of the underlying principles disclosed and claimed herein. Consequently, the scope of the present invention is intended to be limited only by the attached claims.

What is claimed is:

1. A tamper resistant container, comprising:

(a) a bag having an opening;

(b) first and second profiles attached to the bag at the opening, the first and second profiles having respective contact surfaces capable of engaging one another for interlocking the profiles, and third and fourth profiles attached to the bag at the opening and capable of repeatedly engaging one another and repeatedly disengaging one another;

(c) a bonding agent disposed upon at least a portion of at least one of the first and second profiles; and (d) a slider mechanism for moving the contact surfaces into contact such that the bonding agent securely fastens the first and second profiles together.

2. The container of claim 1, wherein the opening of said bag has a first end and a second end, and further comprising a stop attached to the first end of the bag to discourage removal of the slider from the first end, at least one of said profiles being adapted and configured to permit removal of the slider from the second end.

3. The container of claim 1, wherein the bonding agent comprises an epoxy compound.

4. The container of claim 1, wherein the bonding agent comprises an adhesive disposed on at least a portion of at least one of the first profile and the second profile.

5. The container of claim 1, further comprising a scored portion formed along at least a portion of the length of the profiles.

6. A tamper resistant container, comprising:

(a) a bag having an opening;

(b) first and second interlockable fastener strips attachable to said bag opening, said first and second fastener strips having respective first and second profiles attached to the bag at the opening, the first profile having a male protrusion formed thereon and the second profile having a female receptacle formed thereon sized to receive the male protrusion, each of said fastener strips including a downwardly depending flange for attachment to said bag opening;

(c) a bonding agent disposed upon at least a portion of the female receptacle or on a portion of the male protrusion;

(d) a score line between one of said first or second profiles and the corresponding said flange; and (e) a slider mechanism for closing the opening, wherein movement of the slider mechanism causes the male protrusion to be received by the female receptacle and the bonding agent to securely fasten the first and second profiles together.

7. The container of claim 6 wherein the bonding agent comprises an adhesive.

8. The container of claim 6, wherein the bonding agent comprises an epoxy.

9. The container of claim 6, wherein the opening of said bag has a first end and a second end, and further comprising a stop attached to the first end of the bag to impede movement of the slider, at least one of the profiles adapted to permit removal of the slider from the second end.

10. A tamper resistant container, comprising:

(a) a bag having an opening;

(b) first and second profiles attached to the bag at the opening, the first profile having a male protrusion formed thereon and the second profile having a female receptacle formed thereon sized to receive the male protrusion;

(c) a bonding agent disposed on at least a portion of the female receptacle;

(d) a guard moveable from a first position generally between the male protrusion and the female receptacle and second position wherein the guard is not between the male protrusion and the female receptacle; and (e) a slider for closing the opening, the slider including a separator configured to move the guard from the first position to the second position as the slider is moved along the length of the profiles.

11. The container of claim 10, wherein the bonding agent comprises an adhesive.

12. The container of claim 10, wherein the bonding agent comprises an epoxy.

13. The container of claim 10, further comprising a stop attached to the bag to limit movement of the slider mechanism relative to the profiles.

14. The container of claim 10, further comprising a scored portion formed along at least a portion of the length of the profiles.

* * * * *